US010433635B2

(12) United States Patent
Lee

(10) Patent No.: US 10,433,635 B2
(45) Date of Patent: Oct. 8, 2019

(54) TOOTHBRUSH

(71) Applicant: NEOB CO., LTD., Busan (KR)

(72) Inventor: Pal Hyung Lee, Daegu (KR)

(73) Assignee: NEOB CO., LTD., Busan (KR)

( * ) Notice: Subject to any disclaimer, the term of this patent is extended or adjusted under 35 U.S.C. 154(b) by 139 days.

(21) Appl. No.: 15/553,164

(22) PCT Filed: Nov. 20, 2015

(86) PCT No.: PCT/KR2015/012518
§ 371 (c)(1),
(2) Date: Aug. 23, 2017

(87) PCT Pub. No.: WO2016/159478
PCT Pub. Date: Oct. 6, 2016

(65) Prior Publication Data

US 2018/0116387 A1 May 3, 2018

(30) Foreign Application Priority Data

Mar. 28, 2015 (KR) ..... 10-2015-0043736

(51) Int. Cl.
*A46B 7/02* (2006.01)
*A46B 9/02* (2006.01)
(Continued)

(52) U.S. Cl.
CPC ..... *A46B 7/023* (2013.01); *A46B 7/06* (2013.01); *A46B 9/02* (2013.01); *A46B 9/04* (2013.01);
(Continued)

(58) Field of Classification Search
CPC .. A46B 7/023; A46B 7/06; A46B 9/02; A46B 9/04; A46B 9/045
See application file for complete search history.

(56) References Cited

U.S. PATENT DOCUMENTS 4,694,844 A 9/1987 Berl
5,325,560 A * 7/1994 Pavone ..... A46B 5/0029 15/106
(Continued)

FOREIGN PATENT DOCUMENTS

KR 10-0814127 B1 3/2008
KR 10-2008-0107343 A 12/2008
KR 10-1018906 B1 3/2011

*Primary Examiner* — Shay Karls
(74) *Attorney, Agent, or Firm* — Korus Patent, LLC; Seong Il Jeong

(57) ABSTRACT

The present invention is intended to provide a toothbrush which can increase a contact area between teeth and bristles and further enhance frictional force while a head on which the bristles are planted is elastically moving vertically and laterally in accordance with the shapes of the teeth, which can minimize the wear of teeth and the damage of periodontal tissues attributable to booth brushing by adjusting pressure excessively exerted on teeth by a toothbrush user, which enables a patient with a periodontal disease to more easily use bass technique-based tooth brushing, thereby helping the cleanliness of gums and the health of periodontal tissues, maximizing a tooth brushing effect, and contributing to the improvement of oral hygiene, and which can provide the convenience of fabrication.

3 Claims, 4 Drawing Sheets

(51) Int. Cl.
*A46B 9/04* (2006.01)
*A46B 7/06* (2006.01)

(52) U.S. Cl.
CPC ..... *A46B 9/045* (2013.01); *A46B 2200/1066* (2013.01)

(56) References Cited

U.S. PATENT DOCUMENTS

| | | | | |
|---|---|---|---|---|
| 5,956,797 | A | 9/1999 | Wilson | |
| 8,516,645 | B2 * | 8/2013 | Kraemer | A46B 5/0029 15/201 |
| 2001/0050507 | A1 * | 12/2001 | Boucherie | A46D 3/04 300/21 |

* cited by examiner

TOOTHBRUSH

TECHNICAL FIELD

The present invention relates to a toothbrush, and more specifically to a toothbrush which can increase a contact area between teeth and bristles and further enhance frictional force while a head on which the bristles are planted is elastically moving vertically and laterally in accordance with the shapes of the teeth, which can minimize the wear of teeth and the damage of periodontal tissues attributable to booth brushing by adjusting pressure excessively exerted on teeth by a toothbrush user, which enables a patient with a periodontal disease to more easily use bass technique-based tooth brushing, thereby helping the cleanliness of gums and the health of periodontal tissues, maximizing a tooth brushing effect, and contributing to the improvement of oral hygiene, and which can provide the convenience of fabrication.

BACKGROUND ART

Commonly used toothbrushes employ various schemes in which bristles made of a synthetic resin material are planted on a flat head at regular intervals and the bristles are made to have different lengths or diameters so that the bristles can come into close contact with the curved surfaces of teeth and thus maximize a tooth brushing effect.

Furthermore, in the conventional toothbrushes, the bristles are planted upright on the flat head, and thus the bristles cannot be deformed in accordance with the shapes of teeth during tooth brushing, with the result that a contact area is small and thus frictional force is reduced. Therefore, the frictional force of the bristles is not uniformly applied to the surfaces of teeth during tooth brushing, and thus a tooth brushing effect has to be reduced.

In order to overcome the problems of the conventional toothbrushes, the inventor of the present invention has been issued patents and a utility model registration as Korean Patent No. 10-0814127, Korean Patent No. 10-1184334, Korean Patent No. 10-1184337, Korean Patent No. 10-1321571, Korean Patent No. 10-1388967, and Korean Utility Model Registration No. 20-0462621 for a plurality of toothbrushes.

However, the toothbrushes of the patents and the utility model registration require larger numbers of parts and manual processes, and thus problems arise in that productivity is reduced and a unit production cost is increased. Accordingly, there is an urgent need for a means for overcoming these problems.

DISCLOSURE

Technical Problem

An object of the present invention is to provide a toothbrush in which bristles can increase a contact area between teeth and the bristles and further enhance frictional force while elastically moving vertically and laterally in accordance with the shapes of the teeth, thereby effectively performing tooth brushing.

Another object of the present invention is to provide a toothbrush which can minimize the wear of teeth and the damage of periodontal tissues attributable to tooth brushing by adjusting pressure excessively exerted on teeth and which enables a patient with a periodontal disease to more easily use bass technique-based tooth brushing.

Still another object of the present invention is to provide a toothbrush which can be easily fabricated, thereby achieving productivity improvement and cost reduction effects.

Technical Solution

A toothbrush which is provided by the present invention is characterized in that a plurality of elastic strips is formed on the top of a head and bristles are planted on the tops of the elastic strips.

The elastic strips are elastically movable in vertical and lateral directions, and thus the bristles maximize a contact area while elastically moving in accordance with the shapes of teeth, thereby maximizing a tooth brushing effect by means of an increase in frictional force.

Furthermore, a toothbrush may be constructed by partially and selectively planting fixed bristles on the top of a head.

Furthermore, the elastic strips are made of an elastic soft synthetic resin material on the top of the head in an arcuate form or the like.

Furthermore, the head and the elastic strips may be made of the same material or different materials, the fastening portion of the separated fabricated elastic strips is fastened to or fitted into a coupling portion formed on the top of the head by using various methods, and the bristles are planted on the tops of the elastic strips.

Advantageous Effects

In the toothbrushes according to various embodiments of the present invention, the plurality of elastic strips are formed on the head and the bristles are planted on the elastic strips, so that tooth brushing is performed while the elastic strips are elastically moving vertically and laterally in accordance with the various shapes of teeth, thereby maximizing a contact area between teeth and the bristles and thus maximizing a tooth brushing effect, so that the wear of teeth and the damage of periodontal tissues attributable to tooth brushing can be minimized by adjusting pressure excessively exerted on teeth by a toothbrush user, and so that a patient with a periodontal disease is enabled to more easily use bass technique-based tooth brushing, thereby helping the cleanliness of gums and the health of periodontal tissues and contributing to the improvement of oral hygiene.

Furthermore, the toothbrush and the elastic strips can be fabricated in an integrated form by profile injection or the like, thereby achieving productivity improvement and cost reduction effects.

Furthermore, the head and the elastic strip on which the bristles are planted may be separately formed and fitted into each other, so that only the bristles can be replaced when the bristles are worn out or damaged, thereby providing an economic advantage.

MODE FOR INVENTION

The present invention will be described in detail below with reference to the drawings attached to the present invention. First, it should be noted that throughout the drawings, the same components or parts are designated by the same reference symbols as much as possible. In the description of the present invention, detailed descriptions of related well-known functions or configurations will be omitted in order to prevent the gist of the present invention from being made obscure.

The relative terms "about," "substantially," etc. used herein are used to mean numerical values or approximate numerical values of intrinsic manufacturing and material tolerances provided to stated meanings and to prevent any unconscientious violator from unduly taking advantage of the disclosure in which exact or absolute numerical values are given so as to help understand the invention.

Figure 1:
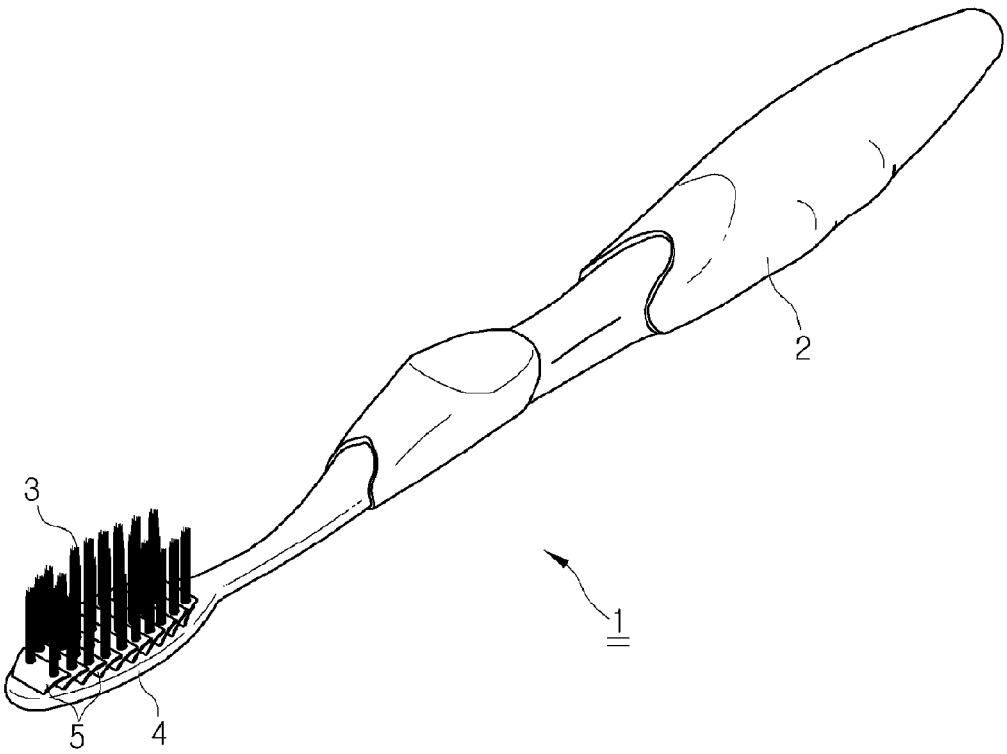
FIG. 1 is a perspective view showing a preferred embodiment of a toothbrush which is provided by the present invention.

FIG. 1 is a perspective view showing a preferred embodiment of a toothbrush which is provided by the present invention.

The toothbrush 1 of the present invention is characterized in that a plurality of elastic strips 5 is formed in the top surface portion of a head 4 configured such that it is formed at the front end of a grip 2 and bristles 3 are planted thereon and the bristles 3 are planted on the elastic strips 5, thereby enabling the bristles 3 to elastically move vertically and laterally in accordance with the shapes of teeth.

Figure 2:
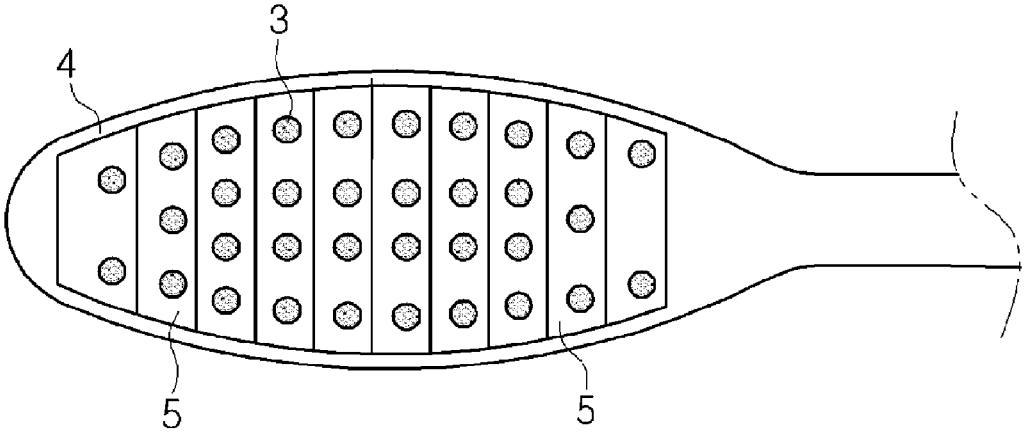
FIG. 2 is an enlarged plan view of an excerpt of a head portion from the toothbrush which is provided by the present invention.
Figure 3:
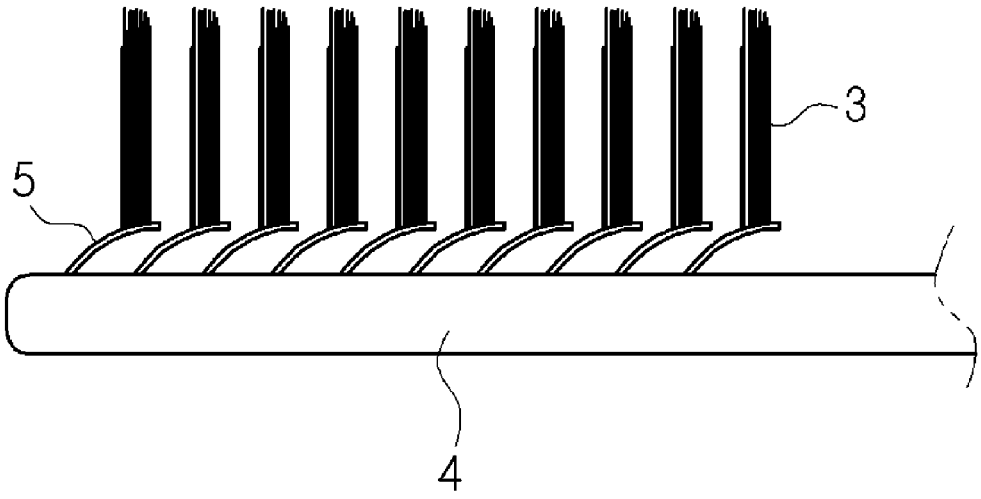
FIG. 3 is an enlarged sectional view of the excerpt of the head portion from the toothbrush which is provided by the present invention.

FIGS. 2 and 3 are plan and sectional views of an excerpt of the head 4 from the toothbrush 1 which is provided by the present invention.

As can be seen from the drawings, the plurality of elastic strips 5 is formed on the top of the head 4 at regular intervals.

The elastic strips 5 may be formed in various directions, such as a direction perpendicular to the lengthwise direction of the toothbrush 1, as shown in the drawings, a direction parallel to the lengthwise direction of the toothbrush 1, a diagonal direction, etc. The elastic strips 5 are formed in an accurate shape to be curved upward, as can be seen from the sectional view thereof. Even when the elastic strips 5 are curved various directions, such as forward and rearward directions in the lengthwise direction of the toothbrush 1, etc., the function thereof has no problem.

If necessary, the elastic strips 5 may be formed in a linear shape including an inclined section and a later section. It is sufficient if the elastic strips 5 are configured such that the bristles 3 can be planted in a direction perpendicular to the head 4.

The elastic strips 5 are made of a soft synthetic resin material by means of a method, such as profile injection or the like, as the same time that the head 4 is made of a hard synthetic resin material.

Although it is preferable for the simplification of a manufacturing process, a reduction in cost, etc. to fabricate the head 4 and the elastic strips 5 in an integrated form by profile-injecting hard and soft synthetic resin materials, it will be apparent that if necessary, it may be possible to fabricate the elastic strips 5 by using one of various materials, such as an elastic metallic material, etc., and then insert the fabricated elastic strips 5 when the head 4 is injection-molded using a synthetic resin material, thereby integrating the elastic strips 5 with the head 4.

The bristles 3 are planted on the tops of the elastic strips 5. When tooth brushing is performed and the ends of the bristles 3 come into contact with teeth and gums, the bristles 3 perform tooth brushing while moving elastically in accordance with the shapes of the teeth and the gums.

Figure 4:
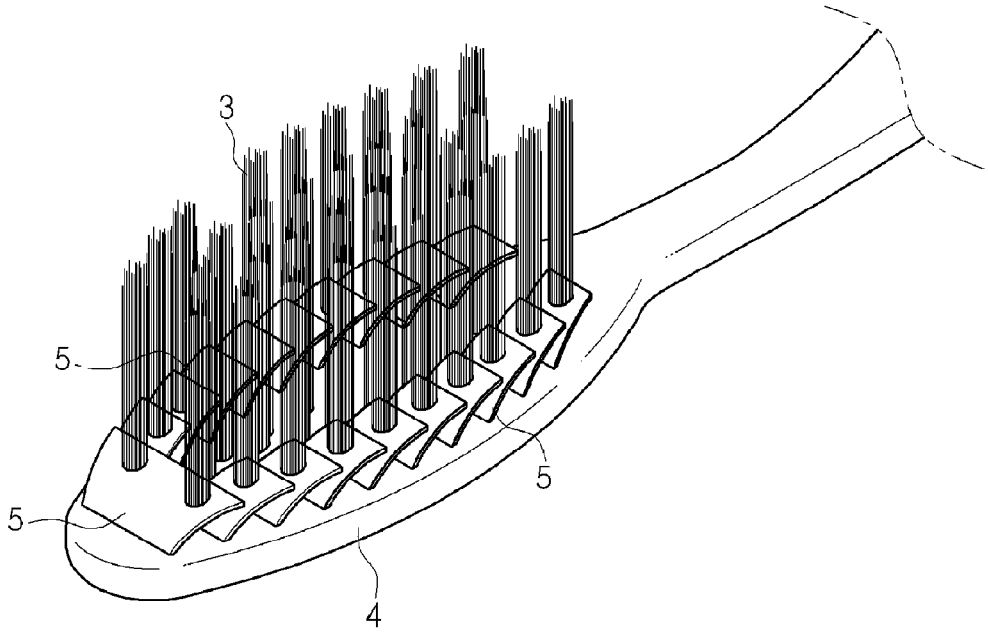
FIG. 4 is a perspective view of an excerpt of a head portion from another embodiment of a toothbrush which is provided by the present invention.
Figure 5:
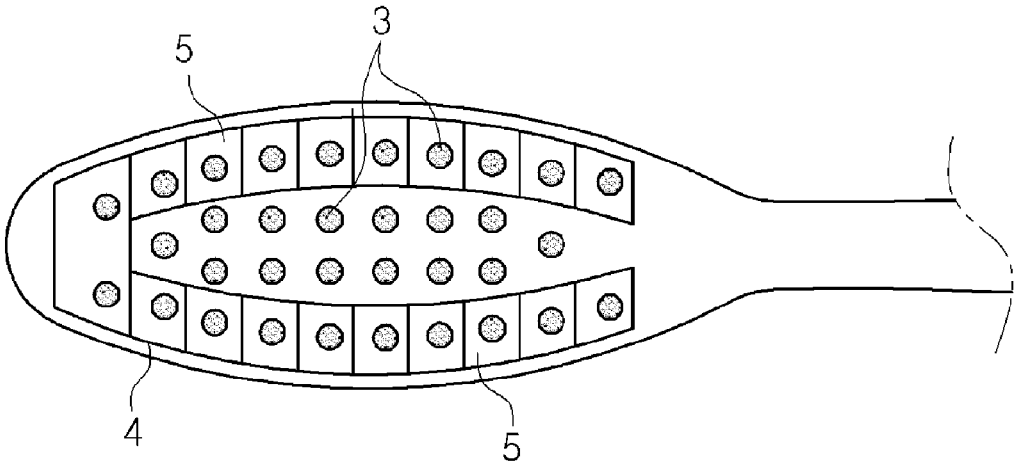
FIG. 5 is an enlarged plan view of an excerpt of a head portion from another embodiment of a toothbrush which is provided by the present invention.

FIGS. 4 and 5 are perspective and enlarged plan views of an excerpt of a head portion from another embodiment of a toothbrush which is provided by the present invention.

These drawings illustrate a case where elastic strips 5 are formed in part of the head 4, bristles 3 are planted on the tops of the elastic strips 5, and relatively invariable and fixed bristles 3 are planted in the remaining area of the head 4 where the former elastic strips 5 are not planted.

In other words, the elastic strips 5 which are formed on the head 4 may be formed throughout the overall top of the head 4, as shown in FIGS. 1 to 3, and the elastic strips 5 may be formed on part of the head 4, as shown in FIGS. 4 and 5. In the latter case, as illustrated in the drawings, the fixed bristles 3 are planted on the center portion of the head 4 in the lengthwise direction of the head 4, the elastic strips 5 are formed in an area surrounding the fixed bristles 3, and the elastically movable bristles 3 are planted on the tops of the elastic strips 5.

It will be apparent that the disposition of the elastic strips 5 is not limited to the illustrated examples, but disposition design may be changed to various forms.

Figure 6:
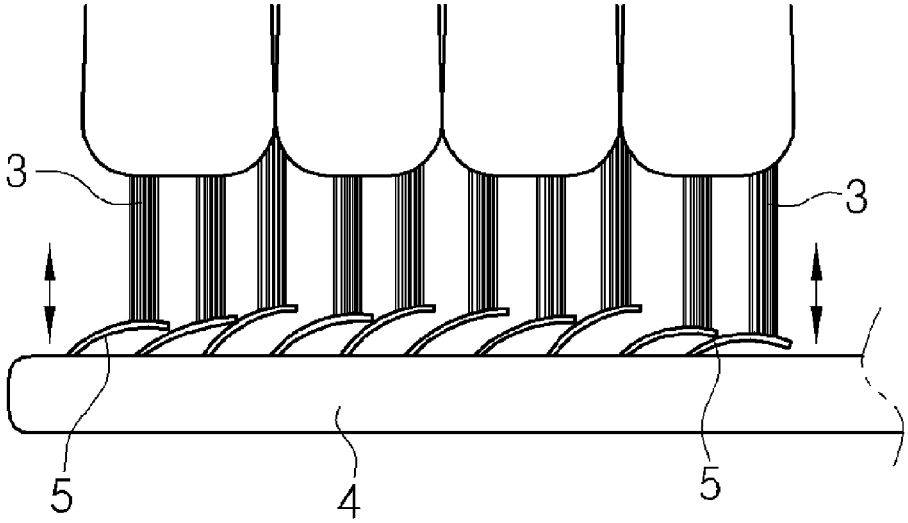
FIG. 6 is a sectional view showing the operating state of the head portion of the toothbrush which is provided by the present invention.

FIG. 6 is a sectional view showing the operating state of the head portion of the toothbrush which is provided by the present invention.

When the bristles 3 planted on the elastic strips 5 of the head 4 constituting part of the toothbrush 1 are brought into contact with teeth in such a way that a user applies pressure in accordance with the shapes of the teeth and gums via the grip 2 during tooth brushing, the bristles 3 enter into a depressed portion and come into contact with a protruding portion while overcoming the elasticity of the elastic strips 5 and making elastic repulsion, and then perform tooth brushing. When continuous tooth brushing is performed, the above-described operation enables the bristles 3 planted on the elastic strips 5 to perform efficient tooth brushing while elastically moving vertically and laterally in accordance with the shapes of teeth and gums and thus increasing a frictional surface area and maximizing frictional force.

In particular, when a patient with a periodontal disease, which has a problem with his or her gums, performs tooth brushing by using a so-called "bass technique" of introducing a toothbrush at about 45° with respect to teeth, performing lateral vibrations a few times, and raising the booth brush up while brushing teeth in order to prevent dental plaque or tartar from being deposited between teeth and gums, the toothbrush 1 of the present invention can perform effective tooth brushing and thus achieve a periodontal disease prevention effect because the bristles 3 are planted on the elastic strips 5 of the head 4 in an elastically repulsive state. Furthermore, the wear of teeth and the damage of periodontal tissues attributable to tooth brushing can be minimized by adjusting pressure excessively exerted on teeth by a toothbrush user.

Figure 7:
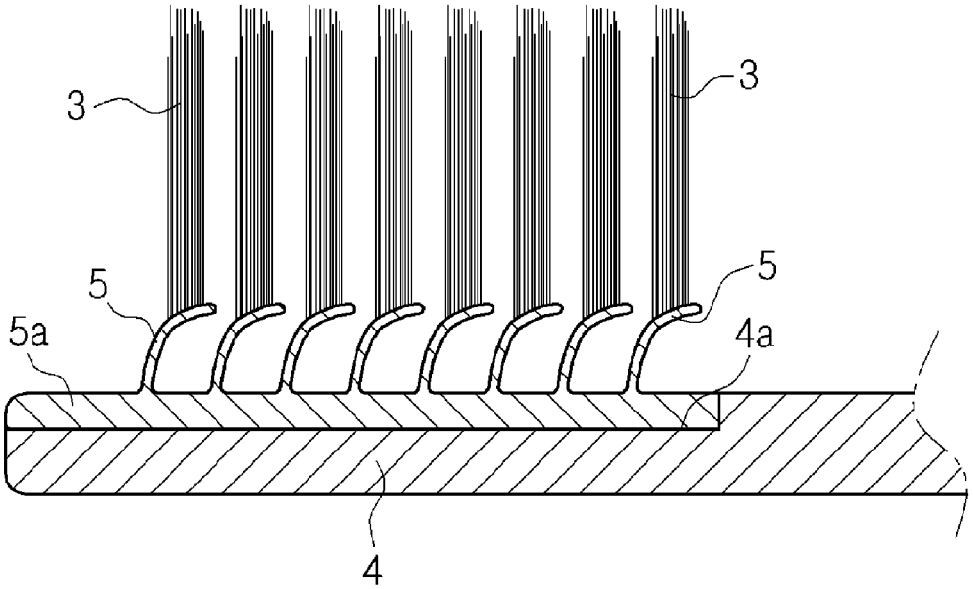
FIG. 7 is an enlarged sectional view of an excerpt of a head portion from still another embodiment of a toothbrush which is provided by the present invention.

FIG. 7 is an enlarged sectional view of an excerpt of a head portion from still another embodiment of a toothbrush which is provided by the present invention.

In other words, in the toothbrush 1 of the present invention, elastic strips 5 which are formed on a head 4 may be made of a material which is the same as or different from that of the head 4. The head 4 and the elastic strips 5 may be separately fabricated using a method, such as injection molding or the like, and may be then integrated into a single body.

When the elastic strips 5 are separately injection-molded, a coupling portion 4*a* may be formed on the head 4, and the fastening portion 5*a* of the elastic strips 5 may be adhered and fastened to the coupling portion 4*a* by using one of various methods.

Figure 8:
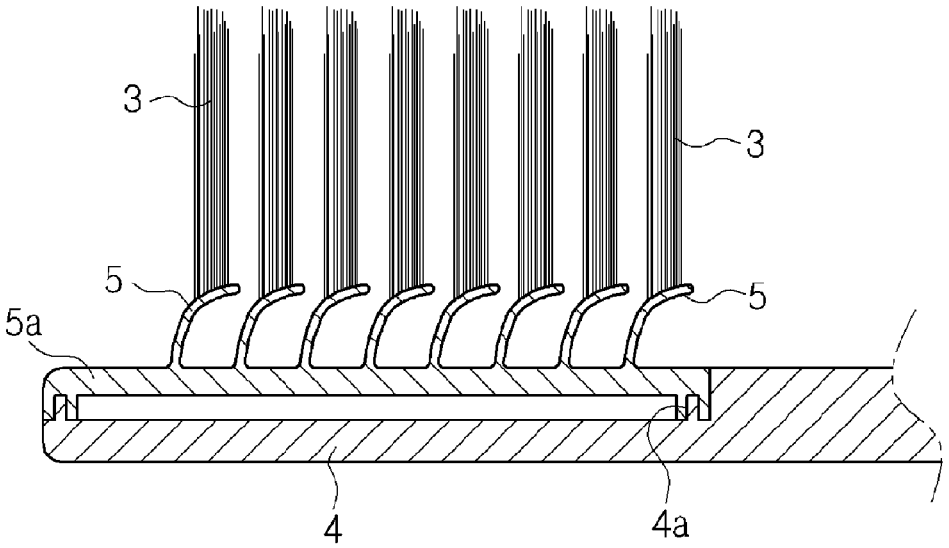
FIG. 8 is an enlarged sectional view of an excerpt of a head portion from yet another embodiment of a toothbrush which is provided by the present invention.

FIG. 8 is an enlarged sectional view of an excerpt of a head portion from yet another embodiment of a toothbrush which is provided by the present invention.

This drawing shows a case where elastic strips 5 which are separately fabricated using a method, such as injection molding or the like, are fastened to a head 4 and the coupling portion 4*a* of the head 4 and the fastening portion 5*a* of the elastic strips 5 are fastened to each other using a fitting method. For the sake of fitting, the coupling portion 4*a* and the fastening portion 5*a* may be configured such that a fitting depression and a fitting protrusion are tightly fitted into each other. In this case, a concomitant advantage is provided in that when bristles 3 are worn out or damaged, only the bristles 3 may be replaced and the remaining portion may be used without change.

The above-described present invention is not limited by the above-described embodiments and the accompanying drawings. It will be apparent to those having ordinary knowledge in the art to which the present invention pertains that various replacements, modifications and alterations may be made without departing from the technical spirit of the present invention.

The invention claimed is:

1. A toothbrush in which a head is formed at a front end of a grip, the toothbrush comprising:

a plurality of elastic strips formed on a top of the head;

wherein the elastic strips are formed to be an arcuate shape in a longitudinal sectional view of the toothbrush, the elastic strips including an inclined portion and a lateral portion, and are made of a soft synthetic resin material, thus being elastically movable in vertical and lateral directions, and wherein bristles are planted on tops of the elastic strips.

2. A toothbrush in which a head is formed at a front end of a grip, the toothbrush comprising:

first bristles planted on a top of the head; and a plurality of elastic strips formed on the top of the head in the vicinity of the first bristles;

wherein the elastic strips are formed to be an arcuate shape in a longitudinal sectional view of the toothbrush, the elastic strips including an inclined portion and a lateral portion, and are made of a soft synthetic resin material, thus being elastically movable in vertical and lateral directions, and wherein second bristles are planted on tops of the elastic strips.

3. A toothbrush in which a head is formed at a front end of a grip, the toothbrush comprising:

elastic strips separately fabricated and fastened to a coupling portion on a top of the head by means of a fastening portion thereof;

wherein the elastic strips are formed to be an arcuate shape in a longitudinal sectional view of the toothbrush, the elastic strips including an inclined portion and a lateral portion, and are made of a soft synthetic resin material, thus being elastically movable in vertical and lateral directions, and wherein bristles are planted on tops of the elastic strips.

* * * * *